US008293690B2

(12) United States Patent
Feustel et al.

(10) Patent No.: US 8,293,690 B2
(45) Date of Patent: Oct. 23, 2012

(54) DISPERSIONS OF POLYMER OIL ADDITIVES

(75) Inventors: Michael Feustel, Koengernheim (DE); Matthias Krull, Harxheim (DE); Christoph Kayser, Mainz (DE); Mario Loew, Niedernhausen (DE)

(73) Assignee: Clariant Finance (BVI) Limited, Tortola (VG)

( * ) Notice: Subject to any disclaimer, the term of this patent is extended or adjusted under 35 U.S.C. 154(b) by 524 days.

(21) Appl. No.: 12/520,358

(22) PCT Filed: Jun. 28, 2007

(86) PCT No.: PCT/EP2007/005714

§ 371 (c)(1),
(2), (4) Date: Jun. 19, 2009

(87) PCT Pub. No.: WO2008/083724

PCT Pub. Date: Jul. 17, 2008

(65) Prior Publication Data

US 2010/0025290 A1 Feb. 4, 2010

(30) Foreign Application Priority Data

Dec. 22, 2006 (DE) ..... 10 2006 061 103

(51) Int. Cl.
*C10M 173/00* (2006.01)
*C10M 161/00* (2006.01)

(52) U.S. Cl. ..... 508/469; 508/472; 508/527; 508/530; 508/579; 508/585; 508/591

(58) Field of Classification Search ..... 526/93; 524/272, 186; 508/472, 287; 44/393; 208/14
See application file for complete search history.

(56) References Cited

U.S. PATENT DOCUMENTS

| | | | | | |
|---|---|---|---|---|---|
| 3,487,036 | A | * | 12/1969 | Bissot | 524/272 |
| 3,562,229 | A | * | 2/1971 | Bauer et al. | 526/93 |
| 3,823,108 | A | * | 7/1974 | Bissot et al. | 524/272 |
| 5,418,278 | A | | 5/1995 | Ritter et al. | |
| 5,851,429 | A | | 12/1998 | Magyar | |
| 5,998,530 | A | | 12/1999 | Krull et al. | |
| 2005/0085588 | A1 | | 4/2005 | Baloche et al. | |
| 2007/0062101 | A1 | | 3/2007 | Delamotte et al. | |

FOREIGN PATENT DOCUMENTS

| | | | |
|---|---|---|---|
| DE | 2354364 | | 5/1974 |
| EP | 0271738 | | 6/1988 |
| EP | 0359061 | | 3/1990 |
| EP | 0448166 | | 9/1991 |
| EP | 0857776 | * | 8/1998 |
| EP | 0890589 | * | 1/1999 |
| WO | WO9809056 | * | 3/1998 |
| WO | WO 98/33846 | | 8/1998 |
| WO | WO 03/014170 | | 2/2003 |
| WO | WO 2005/023907 | | 3/2005 |

OTHER PUBLICATIONS

Ullmanns Encyclopädie der Technischen Chemie, 5th edition, vol. A 21, pp. 305 to 413, 1985-1996.
Römpp Chemie Lexikon, 9th edition, Thieme Verlag 1988-92, vol. 4, p. 3351 ff.
International Search Report for PCT/EP2007/005714 dated Feb. 8, 2000.
English abstract for EP 0271738 dated Jun. 22, 1988.

* cited by examiner

*Primary Examiner* — Ellen McAvoy
*Assistant Examiner* — Chantel Graham
(74) *Attorney, Agent, or Firm* — Tod A. Waldrop

(57) ABSTRACT

The invention relates to dispersions comprising I) at least one polymer that is effective for mineral oils as a cold extrusion improver and is soluble in oil, II) at least one organic solvent that cannot be mixed with water, III) water, IV) at least one alkanolamine salt of a polycyclic carboxylic acid as a dispersing agent, and V) possibly at least one organic solvent that can be mixed with water.

24 Claims, No Drawings

DISPERSIONS OF POLYMER OIL ADDITIVES

Crude oils and products produced therefrom are complex mixtures of different types of substances, some of which can present problems during production, transport, storage and/or further processing. For instance, crude oil and also products derived therefrom, for example middle distillates, heavy heating oil, marine diesel, bunker oil or residue oils, comprise hydrocarbon waxes which precipitate at low temperatures and form a three-dimensional network of flakes and/or fine needles. At low temperatures, among other effects, this impairs the free flow of the oils, for example when transported in pipelines, and, in storage tanks, considerable amounts of oil remain intercalated between the paraffins which crystallize out especially on the tank walls.

Therefore, various types of additives are added to paraffinic mineral oils for transport and storage. These are predominantly synthetic polymeric compounds. So-called paraffin inhibitors include the cold flowability of the oils, for example by modifying the crystal structure of the paraffins which precipitate out on cooling. They prevent the formation of a three-dimensional network of paraffin crystals and thus lead to a lowering of the pour point of the paraffin-containing mineral oils.

The customary polymeric paraffin inhibitors are typically prepared by solution polymerization in organic, predominantly aromatic solvents. Owing to the very long-chain paraffin-like structural elements and high molecular weights of these polymers, which are required for good efficacy, the concentrated solutions thereof possess intrinsic pour points which are often above the ambient temperatures when they are processed. For use, these additives consequently have to be handled in highly dilute form or at elevated temperatures, both of which lead to undesired additional complexity.

Processes have been proposed for preparing paraffin inhibitors by emulsion polymerization, which are said to lead to more readily manageable additives.

For instance, WO-03/014170 discloses pour point depressants prepared by emulsion copolymerization of alkyl(meth) acrylates with water-soluble and/or polar comonomers. These are prepared, for example, in dipropylene glycol monomethyl ether or in water/Dowanol with alkylbenzylammonium chloride and a fatty alcohol alkoxide as emulsifiers.

EP-A-0 359 061 discloses emulsion polymers of long-chain alkyl(meth)acrylates with acidic comonomers. However, the efficacy of these polymers is generally unsatisfactory, presumably owing to the molecular weight distribution altered by the polymerization process, and the highly polar comonomer units incorporated for the purpose of improving the emulsification properties thereof.

A further approach to a solution for the preparation of more readily manageable paraffin inhibitors consists in the emulsification of polymers dissolved in organic solvents in a nonsolvent for the polymeric active ingredient.

For instance, EP-A-0 448 166 discloses dispersions of polymers of ethylenically unsaturated compounds which comprise aliphatic hydrocarbon radicals having at least 10 carbon atoms in glycols and optionally water. The dispersants mentioned are ether sulfates and lignosulfonates. The emulsions are stable at 50° C. for at least one day.

WO-05/023907 discloses emulsions of at least two different paraffin inhibitors selected from ethylene-vinyl acetate copolymers, poly(alkyl acrylates) and alkyl acrylate-grafted ethylene-vinyl acetate copolymers. The emulsions comprise water, an organic solvent, anionic, cationic and/or nonionic surfactants which are not specified any further, and a water-soluble solvent.

WO-98/33846 discloses dispersions of paraffin inhibitors based on ester polymers in aliphatic or aromatic hydrocarbons. The dispersions further comprise a second, preferably oxygen-containing solvent, for example glycol, which is a nonsolvent for the polymer, and optionally water. The dispersants used are anionic surfactants such as carboxylic and sulfonic salts and especially fatty acid salts, nonionic dispersants such as nonylphenol alkoxylates or cationic dispersants such as CTAB. In addition, the emulsions may contain 0.2 to 10% of an N-containing, surface-active monomeric additive such as tall oil fatty acid derivatives and imidazolines.

U.S. Pat. No. 5,851,429 discloses dispersions in which a room temperature solid pour point depressant is dispersed in a nonsolvent. Suitable nonsolvents mentioned include alcohols, esters, ethers, lactones, ethoxyethyl acetate, ketones, glycols and alkylglycols, and mixtures thereof with water. The dispersants used are anionic surfactants such as neutralized fatty acids or sulfonic acids, and also cationic, nonionic, zwitterionic detergents.

A first problem with the proposed solutions of the prior art is a still unsatisfactory long-term stability of the dispersions over several weeks to months, and often an unsatisfactory efficacy of the additives, which is caused firstly by the incorporation of emulsifying monomer units and secondly by inadequate miscibility of the hydrophobic active ingredients from their hydrophilic carrier medium into the mineral oil for treatment. Moreover, it would also be desirable to have available relatively highly concentrated additive formulations which are nevertheless manageable without any problem even at low temperatures.

Consequently, additives have been sought, which are suitable as paraffin inhibitors and especially as pour point depressants for paraffinic mineral oils, and are pumpable as concentrates at low temperatures of below 0° C. and especially below −10° C. These additives should retain their performance and physical properties, such as their phase stability in particular, over a prolonged period of weeks to months even at elevated temperatures. Furthermore, they should exhibit at least the same efficacy as their active ingredients used from mineral oil-based formulations under optimal mixing conditions.

It has been found that, surprisingly, dispersions comprising

I) at least one oil-soluble polymer effective as a cold flow improver for mineral oils,
II) at least one organic, water-immiscible solvent,
III) water,
IV) at least one alkanolamine salt of a polycyclic carboxylic acid as a dispersant and
V) optionally at least one water-miscible organic solvent exhibit low viscosities at room temperature and also lower, and are stable over several weeks at room temperature and also at elevated temperatures of, for example, 50° C. Furthermore, their paraffin-inhibiting efficacy in mineral oils is comparable in each case to that of the formulation of the corresponding active ingredients applied from organic solvent, and often even superior.

The invention thus provides dispersions comprising

I) at least one oil-soluble polymer effective as a cold flow improver for mineral oils,
II) at least one organic, water-immiscible solvent,
III) water,
IV) at least one alkanolamine salt of a polycyclic carboxylic acid and
V) optionally at least one water-miscible organic solvent.

The invention further provides a process for preparing dispersions comprising

I) at least one oil-soluble polymer effective as a cold flow improver for mineral oils, II) at least one organic, water-immiscible solvent, III) water, IV) at least one alkanolamine salt of a polycyclic carboxylic acid and V) optionally at least one water-miscible organic solvent, by homogenizing constituents I), II) and optionally V) with constituent IV), and then admixing them with water at temperatures between 10° C. and 100° C., so as to form an oil-in-water dispersion.

The invention further provides a process for preparing dispersions comprising

I) at least one oil-soluble polymer effective as a cold flow improver for mineral oils, II) at least one organic, water-immiscible solvent, III) water, IV) at least one alkanolamine salt of a polycyclic carboxylic acid and V) optionally at least one water-miscible organic solvent, by mixing constituents I, II, III, IV and optionally V with stirring.

The mixture of water and constituent IV) and optionally V) is preferably admixed with a mixture of constituents I) and II) at temperatures between 10° C. and 100° C.

The invention further provides for the use of dispersions comprising

I) at least one oil-soluble polymer effective as a cold flow improver for mineral oils, II) at least one organic, water-immiscible solvent, III) water, IV) at least one alkanolamine salt of a polycyclic carboxylic acid and V) optionally at least one water-miscible organic solvent for improving the cold flow properties of paraffinic mineral oils and products produced therefrom.

The invention further provides a process for improving the cold flow properties of paraffinic mineral oils and products produced therefrom by adding to paraffinic mineral oils and products produced therefrom dispersions which comprise I) at least one oil-soluble polymer effective as a cold flow improver for mineral oils, II) at least one organic, water-immiscible solvent, III) water, IV) at least one alkanolamine salt of a polycyclic carboxylic acid and V) optionally at least one water-miscible organic solvent.

Cold flow improvers for mineral oils are understood to mean all those polymers which improve the cold properties and especially the cold flowability of mineral oils. The cold properties are measured, for example, as the pour point, cloud point, WAT (wax appearance temperature), paraffin deposition rate and/or cold filter plugging point (CFPP).

Preferred cold flow improvers I) are, for example, i) copolymers of ethylene and ethylenically unsaturated esters, ethers and/or alkenes, ii) homo- or copolymers of esters of ethylenically unsaturated carboxylic acids, said esters bearing $C_{10}$-$C_{30}$-alkyl radicals, iii) ethylene copolymers grafted with ethylenically unsaturated esters and/or ethers, iv) homo- and copolymers of higher olefins, and v) condensation products of alkylphenols and aldehydes and/or ketones.

Suitable copolymers of ethylene and ethylenically unsaturated esters, ethers or alkenes i) are especially those which, as well as ethylene, contain 4 to 18 mol %, especially 7 to 15 mol %, of at least one vinyl ester, acrylic ester, methacrylic ester, alkyl vinyl ether and/or alkene.

The vinyl esters are preferably those of the formula 1

$$CH_2{=}CH{-}OCOR^1 \quad (1)$$

in which $R^1$ is $C_1$- to $C_{30}$-alkyl, preferably $C_4$- to $C_{16}$-alkyl, especially $C_6$- to $C_{12}$-alkyl. The alkyl radicals may be linear or branched. In a preferred embodiment, the alkyl radicals are linear alkyl radicals having 1 to 18 carbon atoms. In a further preferred embodiment, $R^1$ is a branched alkyl radical having 3 to 30 carbon atoms and preferably having 5 to 16 carbon atoms. Particularly preferred vinyl esters are derived from secondary and especially tertiary carboxylic acids whose branch is in the alpha position to the carbonyl group. Especially preferred are the vinyl esters of tertiary carboxylic acids which are also known as Versatic acid vinyl esters and which possess neoalkyl radicals having 5 to 11 carbon atoms, especially having 8, 9 or 10 carbon atoms. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate, and Versatic esters such as vinyl neononanoate, vinyl neodecanoate, vinyl neoundecanoate. An especially preferred vinyl ester is vinyl acetate.

In a further embodiment, the alkyl groups mentioned may be substituted by one or more hydroxyl groups.

In a further preferred embodiment, these ethylene copolymers contain vinyl acetate and at least one further vinyl ester of the formula 1 in which $R^1$ is $C_4$- to $C_{30}$-alkyl, preferably $C_4$- to $C_{16}$-alkyl, especially $C_6$- to $C_{12}$-alkyl. Preferred further vinyl esters are the above-described vinyl esters of this chain length range.

The acrylic and methacrylic esters are preferably those of the formula 2

$$CH_2{=}CR^2{-}COOR^3 \quad (2)$$

in which $R^2$ is hydrogen or methyl and $R^3$ is $C_1$- to $C_{30}$-alkyl, preferably $C_4$- to $C_{16}$-alkyl, especially $C_6$- to $C_{12}$-alkyl. The alkyl radicals may be linear or branched. In a preferred embodiment, they are linear. In a further preferred embodiment, they possess a branch in the 2 position to the ester moiety. Suitable acrylic esters include, for example, methyl (meth)acrylate, ethyl(meth)acrylate, propyl(meth)acrylate, n- and isobutyl(meth)acrylate, and hexyl, octyl, 2-ethylhexyl, decyl, dodecyl, tetradecyl, hexadecyl and octadecyl(meth) acrylate, and mixtures of these comonomers, the formulation "(meth)acrylate" including the corresponding esters of acrylic acid and of methacrylic acid.

The alkyl vinyl ethers are preferably compounds of the formula 3

$$CH_2{=}CH{-}OR^4 \quad (3)$$

in which $R^4$ is $C_1$- to $C_{30}$-alkyl, preferably $C_4$- to $C_{16}$-alkyl, especially $C_6$- to $C_{12}$-alkyl. The alkyl radicals may be linear or branched. Examples include methyl vinyl ether, ethyl vinyl ether, isobutyl vinyl ether.

The alkenes are preferably monounsaturated hydrocarbons having 3 to 30 carbon atoms, more particularly 4 to 16 carbon atoms and especially 5 to 12 carbon atoms. Suitable alkenes include propene, butene, isobutene, pentene, hexene, 4-methylpentene, heptene, octene, decene, diisobutylene and norbornene, and derivatives thereof such as methylnorbornene and vinylnorbornene.

The alkyl radicals $R^1$, $R^3$ and $R^4$ may bear minor amounts of functional groups, for example amino, amido, nitro, cyano, hydroxyl, keto, carbonyl, carboxyl, ester and sulfo groups and/or halogen atoms, provided that they do not significantly impair the hydrocarbon character of the radicals mentioned. In a preferred embodiment, the alkyl radicals $R^1$, $R^3$ and $R^4$, however, do not bear any basic groups and especially no nitrogen-containing functional groups.

Particularly preferred terpolymers contain, apart from ethylene, preferably 3.5 to 17 mol % and especially 5 to 15 mol % of vinyl acetate, and 0.1 to 10 mol % and especially 0.2 to 5 mol % of at least one long-chain vinyl ester, (meth)acrylic ester and/or alkene, where the total comonomer content is between 4 and 18 mol % and preferably between 7 and 15 mol %. Particularly preferred termonomers are vinyl 2-ethylhexanoate, vinyl neononanoate and vinyl neodecanoate. Further particularly preferred copolymers contain, in addition to ethylene and 3.5 to 17.5 mol % of vinyl esters, also 0.1 to 10 mol % of olefins such as propene, butene, isobutene, hexene, 4-methylpentene, octene, diisobutylene, norbornene and/or styrene.

The molecular weight of the ethylene copolymers i) is preferably between 100 and 100 000 and especially between 250 and 20 000 monomer units. The $MFI_{190}$ values of the ethylene copolymers i), measured to DIN 53735 at 190° C. and an applied load of 2.16 kg, are preferably between 0.1 and 1200 g/10 min and especially between 1 and 900 g/min. The degrees of branching determined by means of $^1H$ NMR spectroscopy are preferably between 1 and 9 $CH_3$/100 $CH_2$ groups, especially between 2 and 6 $CH_3$/100 $CH_2$ groups, which do not originate from the comonomers.

Preference is given to using mixtures of two or more of the abovementioned ethylene copolymers. The polymers on which the mixtures are based more preferably differ in at least one characteristic. For example, they may contain different comonomers, different comonomer contents, molecular weights and/or degrees of branching.

The copolymers i) are prepared by known processes (on this subject, see, for example, Ullmanns Encyclopädie der Technischen Chemie, $5^{th}$ edition, vol. A 21, pages 305 to 413). Suitable methods are polymerization in solution, in suspension and in the gas phase, and high-pressure bulk polymerization. Preference is given to employing high-pressure bulk polymerization, which is performed at pressures of 50 to 400 MPa, preferably 100 to 300 MPa, and temperatures of 50 to 350° C., preferably 100 to 300° C. The reaction of the comonomers is initiated by free-radical-forming initiators (free-radical chain initiator). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl)peroxodicarbonate, t-butyl permaleate, t-butyl perbenzoate, dicumyl peroxide, t-butyl cumyl peroxide, di(t-butyl peroxide, 2,2'-azobis(2-methylpropanonitrile), 2,2'-azobis (2-methylbutyronitrile). The initiators are used individually or as a mixture of two or more substances in amounts of 0.01 to 20% by weight, preferably 0.05 to 10% by weight, based on the comonomer mixture.

The desired melt flow index MFI of the copolymers i), for a given composition of the comonomer mixture, is adjusted by varying the reaction parameters of pressure and temperature, and if appropriate by adding moderators. Useful moderators have been found to be hydrogen, saturated or unsaturated hydrocarbons, for example propane and propene, aldehydes, for example propionaldehyde, n-butyraldehyde and isobutyraldehyde, ketones, for example acetone, methyl ethyl ketone, methyl isobutyl ketone and cyclohexanone, or alcohols, for example butanol. Depending on the desired viscosity, the moderators are employed in amounts up to 20% by weight, preferably 0.05 to 10% by weight, based on the comonomer mixture.

The high-pressure bulk polymerization is performed batchwise or continuously in known high-pressure reactors, for example autoclaves or tubular reactors; tubular reactors have been found to be particularly useful. Solvents such as aliphatic hydrocarbons or hydrocarbon mixtures, toluene or xylene may be present in the reaction mixture, although the solvent-free mode of operation has been found to be particularly useful. In a preferred embodiment of the polymerization, the mixture of the comonomers, the initiator and, if used, the moderator is fed to a tubular reactor via the reactor inlet and via one or more side branches. The comonomer streams here may be of different composition (EP-B-0 271 738).

Suitable homo- or copolymers of esters of ethylenically unsaturated carboxylic acids (ii), said esters bearing $C_{10}$-$C_{30}$-alkyl radicals, are especially those which contain repeat structural elements of the formula 4

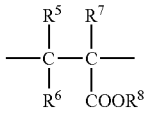

(4)

where $R^5$ and $R^6$ are each independently hydrogen, phenyl or a group of the formula $COOR^8$, $R^7$ is hydrogen, methyl or a group of the formula —$CH_2COOR^8$ and $R^8$ is a $C_{10}$- to $C_{30}$-alkyl or -alkylene radical, preferably a $C_{12}$- to $C_{26}$-alkyl or -alkylene radical, with the proviso that these repeat structural units contain at least one and at most two carboxylic ester units in one structural element.

Particularly suitable homo- and copolymers are those in which $R^5$ and $R^6$ are each hydrogen or a group of the formula $COOR^8$ and $R^7$is hydrogen or methyl. These structural units derive from esters of monocarboxylic acids, for example acrylic acid, methacrylic acid, cinnamic acid, or from mono- or diesters of dicarboxylic acids, for example maleic acid, fumaric acid and itaconic acid. Particular preference is given to the esters of acrylic acid.

Alcohols suitable for the esterification of the ethylenically unsaturated mono- and dicarboxylic acids are those having 10-30 carbon atoms, especially those having 12 to 26 carbon atoms, for example those having 18 to 24 carbon atoms. They may be of natural or synthetic origin. The alkyl radicals are preferably linear or at least very substantially linear. Suitable fatty alcohols include 1-decanol, 1-dodecanol, 1-tridecanol, isotridecanol, 1-tetradecanol, 1-hexadecanol, 1-octadecanol, eicosanol, docosanol, tetracosanol, hexacosanol, and also naturally occurring mixtures, for example coconut fatty alcohol, tallow fatty alcohol, hydrogenated tallow fatty alcohol and behenyl alcohol.

The copolymers of constituent (ii) may, as well as the $C_{10}$-$C_{30}$-alkyl esters of unsaturated carboxylic acids, comprise further comonomers such as vinyl esters of the formula 1, relatively short-chain (meth)acrylic esters of the formula 2, alkyl vinyl ethers of the formula 3 and/or alkenes. Preferred vinyl esters correspond to the definition given for formula 1. Particular preference is given to vinyl acetate. Preferred alkenes are α-olefins, i.e. linear olefins with a terminal double bond, preferably with chain lengths of 3 to 50 and more particularly 6 to 36, especially 10 to 30, for example 18 to 24, carbon atoms. Examples of suitable α-olefins are propene, 1-butene, isobutene, 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-henicosene, 1-docosene, 1-tetracosene. Likewise suitable are commercially available chain cuts, for example $C_{13-18}$-α-olefins, $C_{12-16}$-α-olefins, $C_{14-16}$-α-olefins, $C_{14-18}$-α-olefins, $C_{16-18}$-α-olefins, $C_{16-20}$-α-olefins, $C_{22-28}$-α-olefins, $C_{30+}$-α-olefins.

Additionally suitable as comonomers in constituent ii) are especially ethylenically unsaturated compounds bearing heteroatoms, for example allyl polyglycols, benzyl acrylate, hydroxyethyl acrylate, hydroxypropyl acrylate, hydroxybutyl acrylate, dimethylaminoethyl acrylate, perfluoroalkyl acrylate and the corresponding esters and amides of methacrylic acid, vinylpyridine, vinylpyrrolidone, acrylic acid, methacrylic acid, p-acetoxystyrene and vinyl methoxyacetate. Their proportion in the polymer is preferably less than 20 mol %, especially between 1 and 15 mol %, for example between 2 and 10 mol %.

Allyl polyglycols suitable as comonomers may, in a preferred embodiment of the invention, comprise 1 to 50 ethoxy or propoxy units and correspond to the formula 5:

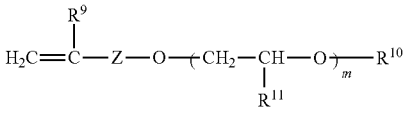

(5)

in which $R^9$ is hydrogen or methyl,

Z is $C_1$-$C_3$-alkyl, $R^{10}$ is hydrogen, $C_1$-$C_{30}$-alkyl, cycloalkyl, aryl or —C(O)-$R^{12}$, $R^{11}$ is hydrogen or $C_1$-$C_{20}$-alkyl, $R^{12}$ is $C_1$-$C_{30}$-alkyl, $C_3$-$C_{30}$-alkenyl, cycloalkyl or aryl and m is from 1 to 50, preferably 1 to 30.

Particular preference is given to comonomers of the formula 5 in which $R^9$ and $R^{11}$ are each hydrogen and $R^{10}$ is hydrogen or a $C_1$-$C_4$-alkyl group.

Preferred homo- or copolymers ii) contain at least 10 mol %, more particularly 20 to 95 mol %, especially 30 to 80 mol %, for example 40 to 60 mol %, of structural units derived from esters of ethylenically unsaturated carboxylic acids, said esters bearing $C_{10}$-$C_{30}$-alkyl radicals. In a specific embodiment, the cold flow improvers ii) consist of structural units derived from esters of ethylenically unsaturated carboxylic acids, said esters bearing $C_{10}$-$C_{30}$-alkyl radicals.

Preferred homo- or copolymers of esters of ethylenically unsaturated carboxylic acids ii), said esters bearing $C_{10}$-$C_{30}$-alkyl radicals, are, for example, poly(alkyl acrylates), poly(alkyl methacrylates), copolymers of alkyl(meth)acrylates with vinylpyridine, copolymers of alkyl(meth)acrylates with allyl polyglycols, esterified copolymers of alkyl(meth)acrylates with maleic anhydride, copolymers of esterified ethylenically unsaturated dicarboxylic acids, for example dialkyl maleates or fumarates, with α-olefins, copolymers of esterified ethylenically unsaturated dicarboxylic acids, for example dialkyl maleates or fumarates, with unsaturated vinyl esters, for example vinyl acetate, or else copolymers of esterified ethylenically unsaturated dicarboxylic acids, for example dialkyl maleates or fumarates, with styrene. In a preferred embodiment, the inventive copolymers ii) do not contain any basic comonomers and more particularly no nitrogen-containing comonomers.

The molecular weights or molar mass distributions of the inventive copolymers are characterized by a K value (measured according to Fikentscher in 5% solution in toluene) of 10 to 100, preferably 15 to 80. The mean molecular weights Mw may be within a range from 5000 to 1 000 000, preferably from 10 000 to 300 000 and especially from 25 000 to 100 000, and are determined, for example, by means of gel permeation chromatography GPC against poly(styrene) standards.

The copolymers ii) are prepared typically by (co)polymerizing esters of ethylenically unsaturated carboxylic acids, especially alkyl acrylates and/or alkyl methacrylates, optionally with further comonomers, by customary free-radical polymerization methods.

A suitable preparation method for preparing the cold flow improvers ii) consists in dissolving the monomers in an organic solvent and polymerizing them in the presence of a free-radical chain initiator at temperatures in the range from 30 to 150° C. Suitable solvents are preferably aromatic hydrocarbons, for example toluene, xylene, trimethylbenzene, dimethylnaphthalene or mixtures of these aromatic hydrocarbons. Commercial mixtures of aromatic hydrocarbons, for example Solvent Naphtha or Shellsol AB®, also find use. Suitable solvents are likewise aliphatic hydrocarbons. Alkoxylated aliphatic alcohols or esters thereof, for example butylglycol, also find use as solvents, but preferably as a mixture with aromatic hydrocarbons. In specific cases, a solvent-free polymerization to prepare the cold flow improvers ii) is also possible.

The free-radical initiators used are typically customary initiators such as azobisisobutyronitrile, esters of peroxycarboxylic acids, for example t-butyl perpivalate and t-butyl per-2-ethylhexanoate, or dibenzoyl peroxide.

A further means of preparing the cold flow improvers ii) consists in the polymer-analogous esterification or transesterification of already polymerized ethylenically unsaturated carboxylic acids, the esters thereof with short-chain alcohols, or the reactive equivalents thereof, for example acid anhydrides with fatty alcohols having 10 to 30 carbon atoms. For example, the transesterification of poly(meth)acrylic acid with fatty alcohols or the esterification of polymers of maleic anhydride and α-olefins with fatty alcohols leads to cold flow improvers ii) suitable in accordance with the invention.

Suitable ethylene copolymers iii) grafted with ethylenically unsaturated esters are, for example, those which a) comprise an ethylene copolymer which, as well as ethylene, contains 4 to 20 mol % and preferably 6 to 18 mol % of at least one vinyl ester, acrylic ester, methacrylic ester, alkyl vinyl ether and/or alkene, onto which b) a homo- or copolymer of an ester of an α,β-unsaturated carboxylic acid with a $C_6$- to $C_{30}$-alcohol has been grafted.

In general, the ethylene copolymer a) is one of the copolymers described as cold flow improvers i). Ethylene copolymers preferred as the copolymer a) for the grafting are especially those which, in addition to ethylene, contain 7.5 to 15 mol % of vinyl acetate. In addition, preferred ethylene copolymers a) possess $MFI_{190}$ values between 1 and 900 g/min and especially between 2 and 500 g/min.

The (co)polymers b) grafted onto the ethylene copolymers a) contain preferably 40 to 100% by weight and especially 50 to 90% by weight of one or more structural units derived from alkyl acrylates and/or methacrylates. Preferably at least 10 mol %, more particularly 20 to 100 mol %, especially 30 to 90 mol %, for example 40 to 70 mol %, of the grafted structural units bear alkyl radicals having at least 12 carbon atoms. Particularly preferred monomers are alkyl(meth)acrylates having $C_{16}$-$C_{36}$-alkyl radicals, especially having $C_{18}$-$C_{30}$-alkyl radicals, for example having $C_{20}$-$C_{24}$-alkyl radicals.

The grafted polymers b) optionally contain 0 to 60% by weight, preferably 10 to 50% by weight, of one or more further structural units which derive from further ethylenically unsaturated compounds. Suitable further ethylenically unsaturated compounds are, for example, vinyl esters of carboxylic acids having 1 to 20 carbon atoms, α-olefins having 6 to 40 carbon atoms, vinylaromatics, dicarboxylic acids and anhydrides and esters thereof with $C_{10}$-$C_{30}$-fatty alcohols, acrylic acid, methacrylic acid and especially ethylenically unsaturated compounds bearing heteroatoms, for example benzyl acrylate, hydroxyethyl acrylate, hydroxypropyl acrylate, hydroxybutyl acrylate, p-acetoxystyrene, vinyl methoxyacetate, dimethylaminoethyl acrylate, perfluoroalkyl acrylate, the isomers of vinylpyridine and derivatives thereof, N-vinylpyrrolidone and (meth)acrylamide and derivatives thereof, such as N-alkyl(meth)acrylamides with $C_1$-$C_{20}$-alkyl radicals. Also suitable as further ethylenically unsaturated compounds are allyl polyglycols of the formula 5 in which $R^9$, $R^{10}$ and $R^{11}$ each have the definitions given under ii).

The graft polymers ii) usually contain ethylene copolymer a) and homo- or copolymer of an ester of an α,β-unsaturated carboxylic acid with a $C_6$- to $C_{30}$-alcohol b) in a weight ratio of 1:10 to 10:1, preferably of 1:8 to 5:1, for example of 1:5 to 1:1.

Graft polymers iii) are prepared by known methods. For example, the graft polymers iii) are obtainable by mixing ethylene copolymer a) and comonomer or comonomer mixture b), optionally in the presence of an organic solvent, and adding a free-radical chain initiator.

Suitable homo- and copolymers of higher olefins (iv) are polymers of α-olefins having 3 to 30 carbon atoms. These may derive directly from monoethylenically unsaturated monomers, or be prepared indirectly by hydrogenation of polymers which derive from polyunsaturated monomers such as isoprene or butadiene. Preferred copolymers contain structural units which derive from α-olefins having 3 to 24 carbon atoms and have molecular weights of up to 120 000 g/mol. Preferred α-olefins are propene, butene, isobutene, n-hexene, isohexene, n-octene, isooctene, n-decene, isodecene. In addition, these polymers may also contain minor amounts of ethylene-derived structural units. These copolymers may also contain small amounts, for example up to 10 mol %, of further comonomers, for example nonterminal olefins or nonconjugated olefins. Particular preference is given to ethylene-propylene copolymers. Additionally preferred are copolymers of different olefins having 5 to 30 carbon atoms, for example poly(hexene-co-decene). They may either be copolymers of random structure, or else block copolymers. The olefin homo- and copolymers can be prepared by known methods, for example by means of Ziegler or metallocene catalysts.

Suitable condensation products of alkylphenols and aldehydes and/or ketones v) are especially those polymers which include structural units which have at least one phenolic OH group, i.e. bonded directly to the aromatic system, and at least one alkyl, alkenyl, alkyl ether or alkyl ester group bonded directly to an aromatic system.

In a preferred embodiment, the condensation products of alkylphenols and aldehydes or ketones (v) are alkylphenol-aldehyde resins. Alkylphenol-aldehyde resins are known in principle and are described, for example, in Römpp Chemie Lexikon, 9th edition, Thieme Verlag 1988-92, Volume 4, p. 3351 ff. Suitable alkylphenol-aldehyde resins in accordance with the invention are especially those which derive from alkylphenols having one or two alkyl radicals in the ortho and/or para position to the OH group. Particularly preferred starting materials are alkylphenols which bear at least two hydrogen atoms capable of condensation with aldehydes on the aromatic, and especially monoalkylated phenols whose alkyl radical is in the para position. The alkyl radicals may be the same or different in the alkylphenol-aldehyde resins usable in the process according to the invention. They may be saturated or unsaturated, preferably saturated. Preferably, the alkyl radicals possess 1-200, preferably 4-50 and especially 6-36 carbon atoms. The alkyl radicals may be linear or branched, preferably linear. Particularly preferred alkyl radicals having more than 6 carbon atoms possess preferably at most one branch per 4 carbon atoms, more preferably at most one branch per 6 carbon atoms, and they are especially linear. Examples of preferred alkyl radicals are n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly(propenyl) and poly(isobutenyl) radicals, and also essentially linear alkyl radicals derived from commercially available raw materials, for example α-olefin chain cuts or fatty acids in the chain length range of, for example, $C_{13-18}$, $C_{12-16}$, $C_{14-16}$, $C_{14-18}$, $C_{16-18}$, $C_{16-20}$, $C_{22-28}$ and $C_{30+}$. Particularly suitable alkylphenol-aldehyde resins derive from linear alkyl radicals having 8 and 9 carbon atoms. Further particularly suitable alkylphenol-aldehyde resins derive from linear alkyl radicals in the chain length range of $C_{12}$ to $C_{36}$.

Suitable aldehydes for the preparation of the alkylphenol-aldehyde resins are those having 1 to 12 carbon atoms and preferably those having 1 to 4 carbon atoms, for example formaldehyde, acetaldehyde, propionaldehyde, butyraldehyde, 2-ethylhexanal, benzaldehyde, glyoxalic acid, and the reactive equivalents thereof, such as paraformaldehyde and trioxane. Particular preference is given to formaldehyde in the form of paraformaldehyde and especially formalin.

The molecular weight of the alkylphenol-aldehyde resins may vary within wide limits. However, a prerequisite for their suitability in accordance with the invention is that the alkylphenol-aldehyde resins are oil-soluble at least in concentrations relevant to use of 0.001 to 1% by weight. The molecular weight measured by means of gel permeation chromatography (GPC) against polystyrene standards in THF is preferably between 400 and 50 000, especially between 800 and 20 000 g/mol, for example between 1000 and 20 000.

In a preferred embodiment of the invention, the cold flow improvers v) are alkylphenol-formaldehyde resins which contain oligo- or polymers with a repeat structural unit of the formula 6

(6)

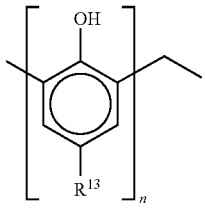

in which $R^{13}$ is $C_1$-$C_{200}$-alkyl or $C_2$-$C_{200}$-alkenyl, and n is from 2 to 250. $R^{13}$ is preferably $C_4$-$C_{50}$-alkyl or -alkenyl and especially $C_6$-$C_{36}$-alkyl or -alkenyl. n is preferably from 3 to 100 and especially from 5 to 50, for example from 10 to 35.

Further preferred alkylphenol-aldehyde resins (v) correspond to the formula 7

(7)

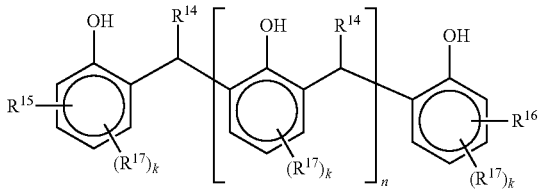

in which $R^{14}$ is hydrogen, a $C_1$- to $C_{11}$-alkyl radical or a carboxyl group, $R^{15}$ and $R^{16}$ are each independently hydrogen, a branched alkyl or alkenyl radical which has 10 to 40 carbon atoms and bears at least one carboxyl, carboxylate and/or ester group, $R^{17}$ is $C_1$-$C_{200}$-alkyl or $C_2$-$C_{200}$-alkenyl, O—$R^{18}$ or O—C(O)—$R^{18}$, $R^{18}$ is $C_1$-$C_{200}$-alkyl or $C_2$-$C_{200}$-alkenyl, n is from 2 to 250 and k is 1 or 2.

The alkylphenol-aldehyde resins suitable in accordance with the invention are obtainable by known methods, for example by condensing the corresponding alkylphenols with formaldehyde, i.e. with 0.5 to 1.5 mol and preferably 0.8 to 1.2 mol of formaldehyde per mole of alkylphenol. The condensation can be effected without solvent, but is preferably effected in the presence of a water-immiscible or only partly water-miscible inert organic solvent, such as mineral oils, alcohols, ethers and the like. Solvents based on biogenic raw materials, such as fatty acid methyl esters, are also suitable as reaction media. Preference is given to effecting the condensation in an organic, water-immiscible solvent II). Particular preference is given to solvents which can form azeotropes with water. The solvents of this type used are especially aromatics such as toluene, xylene, diethylbenzene and relatively high-boiling commercial solvent mixtures such as Shellsol® AB, and Solvent Naphtha. The condensation is effected preferably between 70 and 200° C., for example between 90 and 160° C. It is typically catalyzed by 0.05 to 5% by weight of bases or preferably acids.

The different cold flow improvers (i) to (v) can be used alone or as a mixture of different cold flow improvers of one or more groups. In the case of mixtures, the individual components are used typically with a proportion of 5 to 95% by weight, for example 20 to 90% by weight, based on the total amount of cold flow improver (I) used.

Particularly useful water-immiscible solvents (II) have been found to be aliphatic, aromatic and alkylaromatic hydrocarbons and mixtures thereof. The cold flow improvers (I) usable in accordance with the invention are soluble in these solvents at least to an extent of 20% by weight at temperatures above 50° C. Preferred solvents do not contain any polar groups in the molecule and have boiling points which allow a minimum level of apparatus complexity at the required working temperature of 60° C. and more, i.e. they should have boiling points of at least 60° C. and preferably of 80 to 200° C. under standard conditions. Examples of suitable solvents are: decane, toluene, xylene, diethylbenzene, naphthalene, tetralin, decalin, and commercial solvent mixtures such as Shellsol®, Exxsol®, Isopar®, Solvesso® types, Solvent Naphtha and/or kerosene. In preferred embodiments, the water-immiscible solvents comprise at least 10% by weight, preferably 20 to 100% by weight, for example 30 to 90% by weight, of aromatic constituents. These solvents can also be used for the preparation of the cold flow improvers used in accordance with the invention.

Suitable alkanolammonium salts of polycyclic carboxylic acids (IV) are especially those compounds which are preparable by neutralizing at least one polycyclic carboxylic acid with at least one alkanolamine. Suitable polycyclic carboxylic acids derive from polycyclic hydrocarbons which contain at least two five- and/or six-membered rings which are joined to one another via two preferably vicinal carbon atoms. These rings contain at most one heteroatom, for example oxygen or nitrogen, but all ring atoms are preferably carbon atoms. The rings may be saturated or unsaturated. They may be unsubstituted or substituted and bear at least one carboxyl group or a substituent bearing at least one carboxyl group, or an equivalent of a carboxyl group capable of salt formation with amines.

The polycyclic carboxylic acids preferably contain at least three ring systems which are joined via in each case two vicinal carbon atoms of two ring systems.

In a first preferred embodiment, the polycyclic carboxylic acid on which the alkanolammonium salt (IV) is based is a hydrocarbon compound of the following formula (8):

(8)

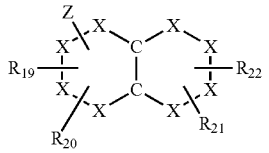

where

X represents carbon, nitrogen and/or oxygen, with the proviso that each of the structural units consisting of four X joined to one another consists either of 4 carbon atoms or 3 carbon atoms and one oxygen atom or one nitrogen atom, $R^{19}$, $R^{20}$, $R^{21}$ and $R^{22}$ are the same or different and are each a hydrogen atom or hydrocarbon groups, each of which is bonded to at least one atom of one of the two rings, these hydrocarbon groups being selected from alkyl groups having one to five carbon atoms, aryl groups, hydrocarbon rings having five to six atoms, which optionally contain a heteroatom, such as nitrogen or oxygen, where the hydrocarbon ring is saturated or unsaturated, unsubstituted or substituted by an optionally olefinic aliphatic radical having one to four carbon atoms, where in each case two of the $R^{19}$, $R^{20}$, $R^{21}$ and $R^{22}$ radicals form such a hydrocarbon ring, and Z is a carboxyl group or an alkyl radical bearing at least one carboxyl group.

In a second preferred embodiment of the invention, the polycyclic hydrocarbon compound is a hydrocarbon compound of the following formula (9):

(9)

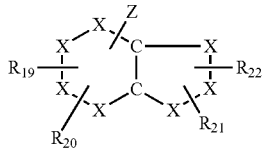

in which at most one X of each ring is a heteroatom, such as nitrogen or oxygen, and the other X atoms are carbon atoms, $R^{19}$, $R^{20}$, $R^{21}$ and $R^{22}$ are each as defined above and Z is bonded to at least one atom of at least one of the two rings and is a carboxyl group or an alkyl radical bearing at least one carboxyl group.

Particularly preferred polycyclic hydrocarbon compounds possess 12 to about 30 carbon atoms and especially 16 to 24 carbon atoms, for example 18 to 22 carbon atoms. Additionally preferably, at least one ring system contains a double bond. The $R^{19}$, $R^{20}$, $R^{21}$ and $R^{22}$ radicals are preferably each alkyl radicals such as methyl, ethyl, n-propyl, isopropyl, n-butyl, isobutyl and tert-butyl. Z is preferably a carboxyl group bonded directly to a ring system. Z is additionally preferably a carboxyl group bonded to a ring system via an alkylene group, for example via a methylene group.

In a specific embodiment, the polycyclic carboxylic acids of the formula (8) and/or (9) used are acids based on natural resins. These natural resins are obtainable, for example, by extracting resinous trees, especially resinous conifers, and can be isolated by distillation from these extracts. Among the resin-based acids, preference is given to abietic acid, dihydroabietic acid, tetrahydroabietic acid, dehydroabietic acid, neoabietic acid, pimaric acid, levopimaric acid and palustric acid, and also derivatives thereof. In practice, it has been found to be useful to use mixtures of different polycyclic carboxylic acids. Preferred mixtures of resin-based acids have acid numbers between 150 and 200 mg KOH/g and especially between 160 and 185 mg KOH/g.

Naphthenic acids are also suitable as polycyclic carboxylic acids. Naphthenic acids are understood to mean mixtures of fused and alkylated cyclopentane- and cyclohexanecarboxylic acids extracted from mineral oils. The mean molecular weights of preferred naphthenic acids are generally between 180 and 350 g/mol and especially between 190 and 300 g/mol. The acid number is preferably in the range of 140-270 mg KOH/g and especially between 180 and 240 mg KOH/g. Suitable alkanolamines for preparing the inventive salts (IV) are primary, secondary and tertiary amines which bear at least one alkyl radical substituted by a hydroxyl group. Preferred amines correspond to the formula 10

$$NR^{23}R^{24}R^{25} \quad (10)$$

in which $R^{23}$ is a hydrocarbon radical which bears at least one hydroxyl group and has 1 to 10 carbon atoms and $R^{24}$, $R^{25}$ are each independently hydrogen, an optionally substituted hydrocarbon radical having 1 to 50 carbon atoms, especially $C_1$- to $C_{20}$-alkyl, $C_3$- to $C_{20}$-alkenyl, $C_6$- to $C_{20}$-aryl, or $R^{23}$, or $R^{23}$ and $R^{24}$ or $R^{23}$ and $R^{25}$ together are a cyclic hydrocarbon radical interrupted by at least one oxygen atom.

$R^{23}$ is preferably a linear or branched alkyl radical. $R^{23}$ may bear one or more, for example two, three or more, hydroxyl groups. In the case that $R^{24}$ and/or $R^{25}$ is also $R^{23}$, preference is given to amines of the formula (10) which bear a total of at most 5 and especially 1, 2 or 3 hydroxyl groups. In a preferred embodiment, $R^{23}$ is a group of the formula $$—(B—O)_p—R \quad (11)$$

in which

B is an alkylene radical having 2 to 6 carbon atoms, preferably having 2 or 3 carbon atoms, p is from 1 to 50, $R^{26}$ is hydrogen, a hydrocarbon radical having 1 to 50 carbon atoms, especially $C_1$- to $C_{20}$-alkyl, $C_2$- to $C_{20}$-alkenyl, $C_6$- to $C_{20}$-aryl or $—B—NH_2$.

B is more preferably an alkylene radical having 2 to 5 carbon atoms and especially a group of the formula $—CH_2—CH_2—$ and/or $—CH(CH_3)—CH_2—$.

p is preferably from 2 to 20 and especially from 3 to 10. In a further particularly preferred embodiment, p is 1 or 2. In the case of alkoxy chains where $p \geqq 3$ and especially where $p \geqq 5$, the chain may be a block polymer chain which has alternating blocks of different alkoxy units, preferably ethoxy and propoxy units. $—(B—O)_p—$ is more preferably a homopolymer. In a specific embodiment, the $R^{24}$ and $R^{25}$ hydrocarbon radicals are each alkyl and alkenyl radicals interrupted by heteroatoms such as nitrogen.

Particularly suitable are alkanolamines in which $R^{23}$ and $R^{24}$ are each independently a group of the formula $—(B—O)_p—H$ and $R^{25}$ is H, in which the definitions of B and p in $R^{23}$ and $R^{24}$ may be the same or different. In particular, the definitions of $R^{23}$ and $R^{24}$ are the same.

In a further particularly preferred embodiment, $R^{23}$, $R^{24}$ and $R^{25}$ are each independently a group of the formula $—(B—O)_p—H$ in which the definitions of B and p in $R^{23}$, $R^{24}$ and $R^{25}$ may be the same or different. In particular, the definitions of $R^{23}$, $R^{24}$ and $R^{25}$ are the same.

Examples of suitable alkanolamines are aminoethanol, 3-amino-1-propanol, isopropanolamine, N-butyldiethanolamine, N,N-diethylaminoethanol, N,N-dimethylisopropanolamine, 2-(2-aminoethoxy)ethanol, 2-amino-2-methyl-1-propanol, 3-amino-2,2-dimethyl-1-propanol, 2-amino-2-hydroxymethyl-1,3-propanediol, diethanolamine, dipropanolamine, diisopropanolamine, di(diethylene glycol) amine, N-butyldiethanolamine, triethanolamine, tripropanolamine, tri(isopropanol)amine, tris(2-hydroxypropylamine), aminoethylethanolamine, and poly(ether)amines such as poly(ethylene glycol)amine and poly(propylene glycol) amine with in each case 4 to 50 alkylene oxide units.

Further compounds suitable as inventive alkanolamines are heterocyclic compounds in which $R^{23}$ and $R^{24}$ or $R^{23}$ and $R^{25}$ together are a cyclic hydrocarbon radical interrupted by at least one oxygen atom. The remaining $R^{24}$ or $R^{25}$ radical in that case is preferably hydrogen, a lower alkyl radical having 1 to 4 carbon atoms or a group of the formula (11) in which B is an alkylene radical having 2 or 3 carbon atoms and p is 1 or 2, and $R^{26}$ is hydrogen or a group of the formula $—B—NH_2$. For example, morpholine and its N-alkoxyalkyl derivatives, for example 2-(2-morpholin-4-ylethoxy)ethanol and 2-(2-morpholin-4-ylethoxy)ethylamine, have been used successfully to prepare the inventive dispersions.

The alkanolamine salts of the polycyclic carboxylic acids can be prepared by mixing the polycyclic carboxylic acids with the appropriate amines. Alkanolamine and polycyclic carboxylic acid can be used, based on the content of acid groups on the one hand and amino groups on the other hand, in a molar ratio of 10:1 to 1:10, preferably of 5:1 to 1:5, especially of 1:2 to 2:1, for example in a ratio of 1.2:1 to 1:1.2. In a particularly preferred embodiment, alkanolamine and polycyclic carboxylic acid are used in equimolar amounts based on the content of acid groups on the one hand and amino groups on the other hand. For better manageability of the polycyclic carboxylic salts, it has been found to be useful to use relatively high-melting salts as a solution or dispersion in one of the solvents (II) and/or (V) and/or in a blend with at least one further coemulsifier of low viscosity.

The polycyclic carboxylic salts can be used as such or in combination with further emulsifiers (coemulsifiers) (VI).

For instance, they are used in a preferred embodiment in combination with anionic, cationic, zwitterionic and/or nonionic emulsifiers.

Anionic coemulsifiers contain a lipophilic radical and a polar head group, which bears an anionic group, for example a carboxylate, sulfonate or phenoxide group. Typical anionic coemulsifiers include, for example, fatty acid salts of fatty acids having a preferably linear, saturated or unsaturated hydrocarbon radical having 8 to 24 carbon atoms. Preferred salts are the alkali metal, alkaline earth metal and ammonium salts, for example sodium palmitate, potassium oleate, ammonium stearate, diethanolammonium talloate and triethanolammonium cocoate. Further suitable anionic coemulsifiers are polymeric anionic surfactants, for example based on neutralized copolymers of alkyl(meth)acrylates and (meth)acrylic acid, and neutralized partial esters of styrene-maleic acid copolymers. Also suitable as coemulsifiers are alkyl-, aryl- and alkylarylsulfonates, sulfates of alkoxylated fatty alcohols and alkylphenols and sulfosuccinates, and especially the alkali metal, alkaline earth metal and ammonium salts thereof.

Cationic coemulsifiers contain a lipophilic radical and a polar head group which bears a cationic group. Typical cationic coemulsifiers are salts of long-chain primary, secondary or tertiary amines of natural or synthetic origin. Also suitable as cationic coemulsifiers are quaternary ammonium salts, for example tetraalkylammonium salts and imidazolinium salts derived from tallow fat.

Zwitterionic coemulsifiers are understood to mean amphiphiles whose polar head group bears both an anionic site and a cationic site which are joined to one another via covalent bonds. Typical zwitterionic coemulsifiers include, for example, N-alkyl N-oxides, N-alkyl betaines and N-alkyl sulfobetaines.

Typical nonionic coemulsifiers are, for example, 10- to 80-tuply, preferably 20- to 50-tuply, ethoxylated $C_8$- to $C_{20}$-alkanols, $C_8$- to $C_{12}$-alkylphenols, $C_8$- to $C_{20}$-fatty acids or $C_8$- to $C_{20}$-fatty acid amides. Further suitable examples of nonionic coemulsifiers are poly(alkylene oxides) in the form of block copolymers of different alkylene oxides such as ethylene oxide and propylene oxide, and partial esters of polyols or alkanolamines with fatty acids.

The coemulsifiers are, if present, used preferably in a weight ratio of 1:20 to 20:1 and especially 1:10 to 10:1, for example 1:5 to 5:1, based on the mass of the polycyclic carboxylic salt.

Particularly preferred coemulsifiers are salts of fatty acids having 12 to 20 carbon atoms and especially of unsaturated fatty acids having 12 to 20 carbon atoms, for example oleic acid, linoleic acid and/or linolenic acid, with alkali metal, ammonium and especially alkanolammonium ions of the formula (10). In a specific embodiment, mixtures of salts of cyclic carboxylic acids and tall oil fatty acids with a content of salts of cyclic carboxylic acids of at least 5% by weight, more particularly between 10 and 90% by weight, especially between 20 and 85% by weight, for example between 25 and 60% by weight, are used. The mixtures are preferably those of salts of so-called resin acids and tall oil fatty acid.

Suitable water-miscible solvents (V) are preferably those solvents which possess a high polarity and especially those which have a dielectric constant of at least 3 and especially at least 10. Such solvents typically contain 10 to 80% by weight of heteroatoms such as oxygen and/or nitrogen. Particular preference is given to oxygen-containing solvents.

Preferred water-miscible organic solvents (V) are alcohols having 2 to 14 carbon atoms, glycols having 2 to 10 carbon atoms and poly(glycols) having 2 to 50 monomer units. The glycols and polyglycols may also be terminally etherified with lower alcohols or terminally esterified with lower fatty acids. However, it is preferred that only one side of the glycol is capped. Examples of suitable water-miscible organic solvents are ethylene glycol, diethylene glycol, triethylene glycol, polyethylene glycols, propylene glycol, dipropylene glycol, polypropylene glycols, 1,2-butylene glycol, 1,3-butylene glycol, 1,4-butylene glycol, glycerol, and the monomethyl ethers, monopropyl ethers, monobutyl ethers and monohexyl ethers of these glycols. Examples of further suitable solvents are alcohols (e.g. methanol, ethanol, propanol), acetates (e.g. ethyl acetate, 2-ethoxyethyl acetate), ketones (e.g. acetone, butanone, pentanone, hexanone), lactones, for example butyrolactone, and alcohols, for example butanol, diacetone alcohol, 2,6-dimethyl-4-heptanol, hexanol, isopropanol, 2-ethylhexanol and 1-pentanol. Particularly preferred water-miscible organic solvents (V) are ethylene glycol and glycerol.

The water-miscible solvents mentioned may be present in a ratio of 1:3 to 3:1, based on the amount of water in the inventive dispersions.

The cold flow improvers (I) usable in accordance with the invention are essentially insoluble in these water-miscible solvents (V) and mixtures thereof with water at least at room temperature and often also at temperatures up to 40° C. and in some cases of up to 50° C., i.e. these solvents dissolve the polymers (I) at room temperature preferably to an extent of less than 5% by weight, especially to an extent of less than 2% by weight, for example to an extent of less than 1% by weight.

The inventive dispersions contain preferably 5-60% by weight of cold flow improver (I)

5-45% by weight of water-immiscible solvent (II)

5-60% by weight of water (III)

0.001-5% by weight of at least one alkanolamine salt of a polycyclic carboxylic acid (IV) and 0-40% by weight of water-miscible solvent (V).

The inventive dispersions more preferably contain 10 to 50 and especially 25 to 45% by weight of the cold flow improver (I). In the case that the cold flow improver of the inventive dispersions is an ethylene copolymer (i), its concentration is especially between 10 and 40% by weight, for example between 15 and 30% by weight. The proportion of the water-immiscible solvent is especially between 10 and 40% by weight, for example between 15 and 30% by weight. The water content of the inventive dispersions is especially between 10 and 40% by weight, for example between 15 and 30% by weight. The proportion of the polycyclic carboxylic salt (IV) is especially between 0.05 and 3% by weight, for example between 0.1 and 2% by weight. In a preferred embodiment, the proportion of the water-miscible solvent (V) is between 2 and 40% by weight and especially between 5 and 30% by weight, for example between 10 and 25% by weight.

To prepare the inventive dispersions, the constituents of the inventive additive can be combined, optionally with heating, and homogenized with heating and stirring. The sequence of addition is not crucial.

In a preferred embodiment, the cold flow improver (I) is dissolved in the water-immiscible solvent (II), optionally while heating. Preference is given to working at temperatures between 20 and 180° C. and especially at temperatures between the melting point of the polymer and the pour point of the polymer in the solvent used and the boiling point of the solvent. The amount of solvent is preferably such that the solutions contain at least 20 and preferably 35 to 60% by weight of dissolved cold flow improver.

The polycyclic carboxylic salt (IV) and optionally coemulsifiers (VI) and, if desired, the water-miscible solvent (III) are added to this viscous solution, preferably with stirring and at an elevated temperature of, for example, 70 to 90° C. The sequence of addition is generally uncritical. The emulsifier (IV) and optionally coemulsifier (VI) can also be added as a solution or dispersion in the water-miscible solvent (V). In a specific embodiment, the polycyclic carboxylic salt is prepared in situ in the polymer solution or in the water-miscible solvent (V) by adding polycyclic carboxylic acid and alkanolamine to the polymer solution or to the water-miscible solvent (V).

In addition, it is also possible to add to the mixture small amounts of further additives, for example pH regulators, pH buffers, inorganic salts, antioxidants, preservatives, corrosion inhibitors or metal deactivators. For example, the addition of approx. 0.5 to 1.5% by weight—based on the total mass of the dispersion—of a defoamer, for example an aqueous polysiloxane emulsion, has been found to be useful.

Subsequently, water (III) is added with vigorous stirring. The water is preferably heated before the addition to a temperature of 50 to 90° C. and especially to a temperature between 60 and 80° C. The water can also be added at higher temperatures, for example temperatures up to 150° C., in which case, however, it is necessary to work in a closed system under pressure. Preference is given to adding water at least until the phase reversal to an oil-in-water suspension, which is recognizable by a decline in viscosity, occurs.

In a further preferred embodiment, the polycyclic carboxylic salt (IV) is initially charged in water and optionally with water-miscible solvent (V), and admixed with the viscous solution of the cold flow improver (I) in the water-immiscible solvent (II).

In practice, it has been found to be particularly useful to adjust the inventive dispersions, for further prevention both of creaming and of settling of dispersed particles, by adding rheology-modifying substances such that the continuous phase has a low yield point. This yield point is preferably within the order of magnitude of 0.01 to 3 Pa, especially between 0.5 and 1 Pa. In the ideal case, this influences the plastic viscosity only to a minor degree, if at all.

The rheology-modifying substances used are preferably water-soluble polymers. In addition to block-polymerized ABA-(polyalkylene glycols) and poly(alkylene glycol) diesters of long-chain fatty acids, especially natural, modified and synthetic water-soluble polymers are suitable. Preferred ABA-block-poly(alkylene glycols) contain preferably A blocks composed of poly(propylene glycol) with mean molecular weights of 100 to 10 000 D, especially of 150 to 1500 D, and B blocks of poly(ethylene glycol) with mean molecular weights of 200 to 20 000 D, especially of 300 to 3000 D. Preferred polyalkylene glycol diesters consist preferably of poly(ethylene glycol) units with a mean molecular weight of 100 to 10 000 D, especially of 200 to 750 D. The long-chain fatty acids of the ester bear preferably alkyl radicals having 14 to 30 carbon atoms, especially having 17 to 22 carbon atoms.

Natural or modified natural polymers preferred as rheology-modifying substances are, for example, guar, carob seed flour and modified derivatives thereof, starch, modified starch, for example dextran, xanthan and xeroglucan, cellulose ethers, for example methylcellulose, carboxymethylcelluylose, hydroxyethylcellulose and carboxymethylhydroxyethylcellulose, and hydrophobically modified, associatively thickening cellulose derivatives and combinations thereof.

Synthetic water-soluble polymers particularly preferred as rheology-modifying substances are especially crosslinked and uncrosslinked homo- and copolymers of (meth)acrylic acid and salts thereof, acrylamidopropanesulfonic acid and salts thereof, acrylamide, N-vinylamides, for example N-vinylformamide, N-vinylpyrrolidone or N-vinylcaprolactam. In particular, the crosslinked and uncrosslinked hydrophobically modified polymers thereof are also of interest as rheology modifiers for inventive formulations.

Viscoelastic surfactant combinations of nonionic, cationic and zwitterionic surfactants are also suitable as rheology-modifying additives.

The rheology-modifying substances are preferably added together with the water. They can, however, also be added to the dispersion, preferably before the shearing. The inventive dispersions preferably contain, based on the amount of water, 0.01 to 5% by weight and especially 0.05 to 1% by weight of one or more rheology-modifying substances.

In a specific embodiment, water and the water-miscible solvent (V) are used as a mixture. This mixture is preferably heated before the addition to a temperature between 50 and 100° C. and especially to a temperature between 60 and 80° C.

After cooling, outstandingly storage-stable, free-flowing and pumpable dispersions are obtained, whose viscosity properties also permit handling at temperatures of little more than 0° C. without addition of the water-miscible solvent (V), and handling at temperatures of down to −10° C. and in many cases to −25° C. with addition of the water-miscible solvent (V).

To improve the long-term stability of the dispersion, it has been found to be useful to reduce the particle size of the dispersions by strong shearing. To this end, the optionally heated dispersion is exposed to high shear rates of at least $10^3$ $s^{-1}$ and preferably of at least $10^5$ $s^{-1}$, for example of at least $10^6$ $s^{-1}$, as can be obtained, for example, by means of toothed disk dispersers (e.g. Ultra-Turrax®), or high-pressure homogenizers with conventional or preferably angular channel architecture (Microfluidizer®). Suitable shear rates are also achievable by means of a Cavitron or ultrasound.

The average particle size of the dispersions is less than 50 μm and especially between 0.1 and 20 μm, for example between 1 and 10 μm.

The inventive dispersions comprising alkanolamine salts of polycyclic carboxylic acids as emulsifiers are low-viscosity liquids in spite of a high active ingredient content of up to 50% by weight. Their viscosities at 20° C. are less than 2000 mPa·s and often less than 1000 mPa·s, for example less than 750 mPa·s. Their intrinsic pour point is typically less than 10° C., often also below 0° C. and in special cases below −10° C., for example below −24° C. They can thus also be used under unfavorable climatic conditions, for example in Arctic regions, and also in offshore applications without further precautions against the solidification of the additives. Application "down-the-hole" is also possible without preceding dilution of the additives and without heating the delivery lines. Furthermore, even at elevated temperatures of more than 30° C., for example more than 45° C., i.e. above the melting temperature of the dispersed polymer, they have an outstanding long-term stability. Even after storage for several weeks and in some cases several months, the inventive dispersions exhibit only negligible amounts, if any, of coagulate or settled solvent. Any inhomogeneities which occur can additionally be homogenized again by simple stirring.

The inventive dispersions are especially suitable for improving the cold properties of crude oils and products produced therefrom, for example heating oils, bunker oils, residue oils, and mineral oils comprising residue oils. Typically, the additized crude oils and the paraffin-containing products derived therefrom contain about 10 to 10 000 ppm and preferably 20 to 5000 ppm, for example 50 to 2000 ppm, of the inventive dispersions. The inventive dispersion, added in amounts of 10 to 10 000 ppm—based on the mineral oil—achieves pour point depressions of frequently more than 10° C., often more than 25° C. and in some cases up to 40° C., both in the case of crude oils and in the case of refined oils, such as lubricant oil or heavy heating oil. Even though they provide the oil-soluble polymeric active ingredient in a medium which is essentially a nonsolvent for this active ingredient, the inventive dispersions exhibit an efficacy superior to the solutions of the pour point depressants in organic solvents used.

EXAMPLES

Preparation of the Emulsifiers

The resin acids used to prepare the inventive emulsifiers are mixtures of polycyclic carboxylic acids which have been obtained proceeding from distillate fractions of natural oils which have been extracted form conifer resins. The main constituents were abietic acid, neoabietic acid, dehydroabietic acid, palustric acid, pimaric acid and levopimaric acid.

To prepare the inventive emulsifiers, the polycyclic carboxylic acids, after dissolution in organic solvent or in unsaturated fatty acids, were stirred with an equimolar amount of the alkanolamine mentioned in the particular experiment and stirred for 30 minutes. In the case of use of fatty acids as the solvent, they were also converted to the alkanolamine salt. The unsaturated fatty acid used was tall oil fatty acid with a fatty acid content of more than 98%.

The viscosities of the dispersions were determined with a plate-cone viscometer with a diameter of 35 mm and a cone angle of 40 at 25° C. and a shear rate of 100 $s^{-1}$. The particle sizes and distributions were determined by means of a Mastersizer 2000 instrument from Malvern Instruments. Pour points were measured to ISO 3016.

Example 1

14 g of an ethylene-vinyl acetate copolymer with a vinyl acetate content of 25% by weight and a mean molecular weight of 100 000 g/mol (measured by means of GPC in THF against poly(styrene) standards), 21 g of ®Solvesso 150 ND (ExxonMobil) and a mixture of 0.4 g of resin acid diethanolammonium salt and 1.1 g of diethanolammonium talloate were homogenized at 80 to 85° C. with stirring and heating. With further stirring, 10 g of monoethylene glycol and then 14 g of water were added to this solution at 80 to 85° C. This formed a white, low-viscosity dispersion. After cooling to 50° C., the dispersion was sheared with an Ultra-Turrax® T45 with G45M tool at 10 000 rpm for 2 minutes.

The dispersion thus obtained had a mean particle size of 1.6 μm and a viscosity of 625 mPa·s (25° C.). After storage of aliquots of this sample at room temperature or at 50° C. for five weeks, the samples were homogeneous and the viscosities were unchanged.

Example 2

0.5 g of resin acid diethanolammonium salt and 1.5 g of diethanolammonium talloate were dissolved in 13 g of monoethylene glycol and heated to 60° C. Subsequently, 36 g of a 50% solution of a poly(stearyl acrylate) with a K value of 32 (measured according to Fikentscher in 5% solution) in xylene were added in portions with stirring within 15 minutes. After homogenization, 13 g of water which contained 2.5 g/l of xanthan and 1.0 g/l of biocide were added, in the course of which the temperature of the microdispersion which formed was kept constant at 60° C.

After the reaction solution had been cooled to 40° C., it was sheared by means of an Ultra-Turrax® T2B with S25N-25F tool at 20 000 rpm for 2 min.

The dispersion thus obtained had a viscosity of 140 mPa·s. After storing an aliquot of this sample at room temperature or at 50° C. for six weeks, the samples were homogeneous and the viscosities were unchanged.

Example 3

The solution of 33 g of an ethylene-vinyl acetate copolymer which had been grafted with behenyl acrylate in a weight ratio of 4:1 and had a vinyl acetate content of 28% by weight and an $MFI_{190}$ of 7 g/10 minutes in 22 g of xylene was admixed with 0.8 g of resin acid diethanolammonium salt and 2.2 g of diethanolammonium talloate, and heated to 85° C. with stirring. 19 g of monoethylene glycol and then 23 g of water were added slowly to this solution at 80 to 85° C. with further stirring. This formed a white, low-viscosity suspension. After cooling to 50° C., the suspension was sheared at 10 000 rpm with an Ultra-Turrax® T45 with G45M tool for 2 minutes.

The dispersion thus obtained had a mean particle size of 1.7 μm and a viscosity of 270 mPa·s. After storing aliquots of this sample for five weeks at room temperature or at 50° C., the samples were homogeneous and the viscosities were unchanged.

Example 4

600 g of an ethylene-vinyl acetate copolymer which had been grafted with stearyl acrylate in a weight ratio of 3:1 and had a vinyl acetate content of 28% by weight and an $MFI_{190}$ of 7 g/10 minutes, 400 g of xylene, 12 g of resin acid, 33 g of tall oil fatty acid and 15 g of diethanolamine were heated to 85° C. with stirring. 450 g of monoethylene glycol and then 450 g of water which contained 2.5 g/l of xanthan and 2 g/l of biocide were added slowly to this solution at 80 to 85° C. with further stirring. This formed a white, low-viscosity suspension. After cooling to 50° C., the suspension was sheared with an Ultra-Turrax® T25 b Inline with S25KV-25F-IL tool at 20 000 rpm in pumped circulation for 60 minutes.

The dispersion thus obtained had a mean particle size of 1.9 μm and a viscosity of 312 mPa·s. After storing aliquots of this sample at room temperature or at 50° C. for six weeks, the samples were homogeneous and their viscosities were unchanged.

Example 5

600 g of an ethylene-vinyl acetate copolymer which had been grafted with stearyl acrylate in a weight ratio of 3:1 and had a vinyl acetate content of 28% by weight and an $MFI_{190}$ of 7 g/10 minutes, 400 g of xylene, 12 g of resin acid, 33 g of tall oil fatty acid and 15 g of diethanolamine were heated to 85° C. with stirring, and homogenized. 450 g of monoethylene glycol and then 450 g of water which contained 2.5 g/l of xanthan and 2 g/l of biocide were added slowly to this solution at 80 to 85° C. with further stirring. This formed a white, low-viscosity suspension. After cooling to 50° C., the suspension was sheared 10 times with an Ultra-Turrax® T25 b Inline with S25KV-25F-IL tool at 20 000 rpm while being transferred from one vessel to another.

The dispersion thus obtained had a mean particle size of 1.7 μm and a viscosity of 283 mPa·s. After storing aliquots of this sample at room temperature or at 50° C. for six weeks, the samples were homogeneous and their viscosities were unchanged.

Example 6

0.5 g of resin acid diethanolammonium salt and 1.5 g of diethanolammonium talloate were dissolved in 13 g of monoethylene glycol and heated to 60° C. Subsequently, 36 g of a 50% solution of a copolymer of maleic anhydride and $C_{20-24}$-α-olefin which had been esterified with behenic acid in ®Shellsol AB were added in portions with stirring within 15 minutes. After homogenization, 13 g of water were added, in the course of which the temperature of the microdispersion which formed was kept constant at 60° C.

After the reaction solution had been cooled to 40° C., it was sheared by means of an Ultra-Turrax® T2B with S25N-25F tool at 20 000 rpm for 2 min.

The dispersion thus obtained had a viscosity of 280 mPa·s. After storing an aliquot of this sample at room temperature or at 50° C. for six weeks, the samples were homogeneous and the viscosities were unchanged.

Example 7 (Comparative)

25 g of an ethylene-vinyl acetate copolymer with a vinyl acetate content of 25% by weight and a mean molecular weight of 100 000 g/mol (measured by means of GPC in THF against poly(styrene) standards), 35 g of xylene and 4 g of diethanolammonium talloate (content of oleic acid, linoleic acid and linolenic acid together more than 98% by weight in the tall oil fatty acid used) were heated to 85° C. with stirring. 16 g of monoethylene glycol and then 22 g of water were added slowly to this solution at 80 to 85° C. with further stirring. This formed a white viscous dispersion. After cooling to 50° C., the dispersion was sheared at 10 000 rpm with an Ultra-Turrax® T45 with G45M tool for 2 minutes.

The dispersion thus obtained had a mean particle size of 4 μm. After storing aliquots of this sample either at room temperature or at 50° C. overnight, the samples exhibited significant inhomogeneities in the form of creaming of the polymer or gel formation (pastelike) and simultaneous deposition of clear solvent with higher specific weight.

Example 8

A solution of 18 g of an ethylene-vinyl acetate copolymer which had been grafted with behenyl acrylate in a weight ratio of 4:1 and had a vinyl acetate content of 28% by weight and an $MFI_{190}$ of 7 g/10 minutes in 18 g of xylene was heated to 75° C. Within 30 min, this solution was added with stirring in portions to a solution, heated to 60° C., of 2 g of an emulsifier which had been prepared by reacting a solution of 26% by weight of resin acids in tall oil fatty acid with 2-(2-morpholin-4-ylethoxy)ethanol in a weight ratio of 3:1 in 13 g of monoethylene glycol. 13 g of water were added slowly to this solution at 80 to 85° C. with further stirring. This formed a white, low-viscosity suspension. After cooling to 40° C., the suspension was sheared with an Ultra-Turrax® T45 with G45M tool at 10 000 rpm for 2 minutes.

The dispersion thus obtained had a mean particle size of 1.5 μm and a viscosity of 1180 mPa·s. After storing aliquots of this sample at room temperature or at 50° C. for six weeks, the samples were homogeneous and the viscosities were unchanged.

Example 9

According to Example 8, except that a dispersion was prepared, in which the alkanolamine used was triethanolamine in place of the 2-(2-morpholin-4-ylethoxy)ethanol. This resulted in a microdispersion with a viscosity of 137 mPa·s. After storing aliquots of this sample at room temperature or at 50° C. for six weeks, the samples were homogeneous and the viscosities were unchanged.

Example 10

A solution of 18 g of an ethylene-vinyl acetate copolymer which had been grafted with behenyl acrylate in a weight ratio of 4:1 and had a vinyl acetate content of 28% by weight and an $MFI_{190}$ of 7 g/10 minutes in 18 g of xylene was heated to 60° C. A mixture of 0.5 g of resin acid triethanolammonium salt and 1.5 g of triethanolammonium talloate was added with stirring and homogenized for 30 minutes. 26 g of water which contained 2.5 g/l of xanthan and 1 g/l of biocide were added slowly to this solution at 80 to 85° C. with further stirring. This formed a white, low-viscosity suspension. After cooling to 40° C., the suspension was sheared with an Ultra-Turrax® T25B with S25M-25F tool at 20 000 rpm for 2 minutes.

The dispersion thus obtained had a viscosity measured at 25° C. of 78 mPa·s. After storing aliquots of this sample at room temperature or at 50° C. for six weeks, the samples were homogeneous and the viscosities were unchanged.

Example 11

According to Example 8, a dispersion was prepared using 2 g of a mixture of equal parts by weight of diethanolammonium naphthenate (acid number of the naphthenic acid used 260 mg KOH/g, Mw: 216 g/mol) and diethanolammonium talloate as an emulsifier. The resulting microdispersion had a viscosity measured at 25° C. of 139 mPa·s. After storing aliquots of this sample at room temperature or at 50° C. for six weeks, the samples were homogeneous and the viscosities were unchanged.

Example 12

According to Example 8, a dispersion was prepared using 2.3 g of a mixture of equal parts by weight of resin acid diethanolammonium salt and xylene as an emulsifier. The resulting microdispersion had a viscosity measured at 25° C. of 143 mPa·s. After storing aliquots of this sample at room temperature or at 50° C. for six weeks, the samples were homogeneous and the viscosities were unchanged.

Example 13

0.5 g of resin acid diethanolammonium salt and 1.5 g of diethanolammonium talloate were dissolved in 13 g of monoethylene glycol and heated to 60° C. Subsequently, 36 g of a 50% solution of an alkylphenol-formaldehyde resin (Mw: 1500 g/mol) in xylene were added in portions with stirring within 15 minutes. After homogenization, 13 g of water which contained 2.5 g/l of xanthan and 1.0 g/l of biocide were added, in the course of which the temperature of the microdispersion which formed was kept constant at 60° C.

After the reaction solution had been cooled to 40° C., it was sheared by means of an Ultra-Turrax® T25B with S25N-25F tool at 20 000 rpm for 2 min.

The dispersion thus obtained had a viscosity of 163 mPa·s. After storing an aliquot of this sample at room temperature or at 50° C. for six weeks, the samples were homogeneous and the viscosities were unchanged.

Efficacy as a Pour Point Depressant

The testing of the efficacy of the inventive dispersions and of the solutions in aromatic solvents used for their preparation was undertaken in various crude oils and residue oils. Pour points were determined to DIN ISO 3016.

1. Crude oil ("white tiger", origin: Vietnam; pour point: +36° C.)

| Additive | PP @ 625 ppm | PP @ 1250 ppm |
|---|---|---|
| Example 2 | +12° C. | +6° C. |
| Example 3 | +12° C. | +6° C. |
| Poly(stearyl acrylate) from Example 2 28% in xylene (comparative) | +15° C. | +9° C. |
| Graft polymer from Example 3 33% in xylene (comparative) | +15° C. | +9° C. |

2. Residue oil ("HFO", heavy fuel oil, origin: Germany; pour point: +30° C.)

| Additive | PP@ 1000 ppm |
|---|---|
| Example 1 | +6° C. |
| Example 9 | +6° C. |
| EVA polymer from Example 1 23% in Solvent Naphtha (comparative) | +9° C. |
| Polymer from Example 9 28% in Solvent Naphtha (comparative) | +9° C. |

3. Crude oil ("Bombay High", origin: India; pour point: +30° C.)

| Additive | PP @ 300 ppm | PP@ 2000 ppm |
|---|---|---|
| Example 3 | +15° C. | −6° C. |
| Example 6 | +12° C. | −6° C. |
| Graft polymer from Example 3, 33% in xylene (comparative) | +15° C. | 0° C. |
| Polymer from Example 6, 28% in Naphtha (comparative) | +15° C. | −3° C. |

The experiments show that the superior stability of the inventive dispersions is caused to a crucial degree by the presence of alkanolamine salts of polycyclic carboxylic acids. They additionally show that the efficacy of the active ingredients formulated in the form of the inventive dispersions is at least equal and in various cases even superior to the solutions of the corresponding active ingredients in organic solvents.

The invention claimed is:

1. A dispersion comprising

I) at least one oil-soluble polymer effective as a cold flow improver for mineral oils, II) at least one organic, water-immiscible solvent, III) water, IV) at least one alkanolamine salt of a polycyclic carboxylic acid and V) optionally at least one water-miscible organic solvent.

2. The dispersion as claimed in claim 1, in which the cold flow improver I is a copolymer of ethylene and at least one ethylenically unsaturated ester or ether or an alkene.

3. The dispersion as claimed in claim 1, in which the cold flow improver is a homo- or copolymer of at least one ester of at least one ethylenically unsaturated carboxylic acid, said ester bearing $C_{10}$-$C_{30}$-alkyl radicals.

4. The dispersion as claimed in claim 2, in which the ethylenically unsaturated ester is a vinyl ester.

5. The dispersion as claimed in claim 3, in which the ethylenically unsaturated carboxylic acid is acrylic acid and/or methacrylic acid.

6. The dispersion as claimed in claim 1, in which the cold flow improver is an ethylene copolymer grafted with ethylenically unsaturated esters and/or ethers.

7. The dispersion as claimed in claim 6, wherein the ethylenically unsaturated ester is an ester of acrylic acid and/or methacrylic acid, said ester bearing $C_{10}$-$C_{30}$-alkyl radicals.

8. The dispersion as claimed in claim 1, in which the cold flow improver is a homo- and copolymer of a-olefins having 3 to 30 carbon atoms.

9. The dispersion as claimed in claim 1, in which the cold flow improver is a condensation product of at least one alkylphenol and at least one aldehyde or ketone.

10. The dispersion as claimed in claim 9, in which the condensation product corresponds to the formula 6

(6)

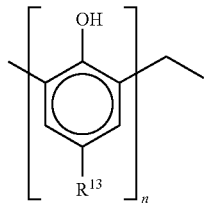

in which $R^{13}$ is $C_1$-$C_{200}$-alkyl or $C_2$-$C_{200}$-alkenyl, and n is from 2 to 250.

11. The dispersion as claimed in claim 1, in which the dispersant IV is preparable by neutralizing at least one polycyclic carboxylic acid with at least one alkanolamine.

12. The dispersion as claimed in claim 1, in which the polycyclic carboxylic acid derives from at least one polycyclic hydrocarbon which contains at least two five- and/or six-membered rings which are joined to one another via two preferably vicinal carbon atoms.

13. The dispersion as claimed in claim 1, in which the polycyclic carboxylic acid corresponds to the formula 8

(8)

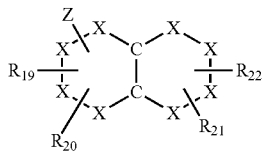

where

X represents carbon atoms, or three carbon, nitrogen and/or oxygen, with the proviso that each of the structural units consisting of four X joined to one another consists either of 4 carbon atoms or 3 carbon atoms and one oxygen atom or one nitrogen atom, $R^{19}$, $R^{20}$, $R^{21}$ and $R^{22}$ are the same or different and are each a hydrogen atom or hydrocarbon groups, each of which is bonded to at least one atom of one of the two rings, these hydrocarbon groups are selected from the group consisting of:

alkyl groups having one to five carbon atoms, aryl groups, and hydrocarbon rings having five to six atoms, which optionally contain a heteroatom, such as nitrogen or oxygen, where the hydrocarbon ring is saturated or unsaturated, unsubstituted or substituted by an optionally olefinic aliphatic radical having one to four carbon atoms, where in each case two of the $R^{19}$, $R^{20}$, $R^{21}$ and $R^{22}$ radicals form such a hydrocarbon ring, and Z is a carboxyl group or an alkyl radical bearing at least one carboxyl group.

14. The dispersion as claimed in claim 1, in which the polycyclic carboxylic acid corresponds to the formula (9):

(9)

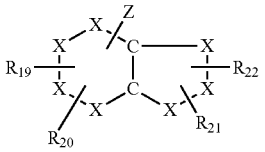

in which at most one X of each ring is a heteroatom, such as nitrogen or oxygen, and the other X atoms are carbon atoms, $R^{19}$, $R^{20}$, $R^{21}$ and $R^{22}$ are the same or different and are each a hydrogen atom or hydrocarbon groups, each of which is bonded to at least one atom of one of the two rings, these hydrocarbon groups are selected from the group consisting of:

alkyl groups having one to five carbon atoms, aryl groups, and hydrocarbon rings having five to six atoms, which optionally contain a heteroatom, such as nitrogen or oxygen, where the hydrocarbon ring is saturated or unsaturated, unsubstituted or substituted by an optionally olefinic aliphatic radical having one to four carbon atoms, where in each case two of the $R^{19}$, $R^{20}$, $R^{21}$ and $R^{22}$ radicals form such a hydrocarbon ring, and Z is bonded to at least one atom of at least one of the two rings and is a carboxyl group or an alkyl radical bearing at least one carboxyl group.

15. The dispersion as claimed in claim 1, in which the polycyclic carboxylic acid is an acid based on natural resins.

16. The dispersion as claimed in claim 1, in which the polycyclic carboxylic acid is a naphthenic acid.

17. The dispersion as claimed in claim 1, in which the alkanolamine is a primary, secondary or tertiary amine which bears at least one alkyl radical substituted by a hydroxyl group.

18. The dispersion as claimed in claim 1, in which the alkanolamine corresponds to the following formula 10:

$$NR^{23}R^{24}R^{25} \quad (10)$$

in which $R^{23}$ is a hydrocarbon radical which bears at least one hydroxyl group and has 1 to 10 carbon atoms and $R^{24}$, $R^{25}$ are each independently hydrogen, an optionally substituted hydrocarbon radical having 1 to 50 carbon atoms, especially $C_1$- to $C_{20}$-alkyl, $C_3$- to $C_{20}$-alkenyl, $C_6$- to $C_{20}$-aryl, or $R^{23}$, or $R^{23}$ and $R^{24}$ or $R^{23}$ and $R^{25}$ together are a cyclic hydrocarbon radical interrupted by at least one oxygen atom.

19. The dispersion as claimed in claim 18, in which the alkanolamine is a heterocyclic compound of the formula (10) in which $R^{23}$ and $R^{24}$ or $R^{23}$ and $R^{25}$ together are a cyclic hydrocarbon radical interrupted by at least one oxygen atom, and the remaining $R^{24}$ or $R^{25}$ radical is hydrogen, a lower alkyl radical having 1 to 4 carbon atoms or a group of the formula (11)

$$—(B—O)_p—R^{26} \quad (11)$$

in which B is an alkylene radical having 2 or 3 carbon atoms and p is 1 or 2, and $R^{26}$ is hydrogen or a group of the formula $—B—NH_2$.

20. The dispersion as claimed in claim 1, in which the polycyclic carboxylic salt IV is used together with a coemulsifier.

21. The dispersion as claimed in claim 1, in which the water-miscible solvent (V) has a dielectric constant of at least 3.

22. The dispersion as claimed in claim 1, in which the water-miscible solvent (V) is selected from the group consisting of alcohols, glycols, poly(glycols), acetates, ketones and lactones.

23. The dispersion as claimed in claim 1, which comprises 5-60% by weight of cold flow improver (I), 5-45% by weight of water-immiscible solvent (II), 5-60% by weight of water (III), 0.001-5% by weight of at least one alkanolamine salt of a polycyclic carboxylic acid (IV), and 0-40% by weight of water-miscible solvent (V).

24. The dispersion as claimed in claim 1, further comprising a rheology-modifying substance which causes a yield point.

* * * * *